US006883664B2

(12) United States Patent
Lee

(10) Patent No.: US 6,883,664 B2
(45) Date of Patent: Apr. 26, 2005

(54) TOOL DISPLAY MEMBER

(76) Inventor: Daniel Lee, No. 62, Jen-Mei Rd., 3 Lin, Jen-Hua Li, Tali City, Taichung Hsien (TW)

( * ) Notice: Subject to any disclaimer, the term of this patent is extended or adjusted under 35 U.S.C. 154(b) by 34 days.

(21) Appl. No.: 10/223,729

(22) Filed: Aug. 20, 2002

(65) Prior Publication Data

US 2004/0035731 A1 Feb. 26, 2004

(51) Int. Cl.[7] ..... B65D 85/00

(52) U.S. Cl. ..... 206/349; 206/477; 206/493; 206/806

(58) Field of Search ..... 206/493, 349, 206/372, 373, 376–378, 477, 480, 485, 806; 211/70.6

(56) References Cited

U.S. PATENT DOCUMENTS 3,302,776 A * 2/1967 Sparks ..... 206/485
4,450,961 A * 5/1984 Bies et al. ..... 206/349
5,769,226 A * 6/1998 Arai ..... 206/455
5,785,174 A * 7/1998 Chow ..... 206/349
5,988,381 A * 11/1999 Ling ..... 206/349
6,164,463 A * 12/2000 Lee ..... 211/70.6
6,193,200 B1 * 2/2001 Kao ..... 248/309.1
6,241,092 B1 * 6/2001 Vasudeva ..... 206/349
6,315,119 B1 * 11/2001 Lee ..... 206/349
6,378,700 B1 * 4/2002 Tong ..... 206/376
6,679,379 B1 * 1/2004 Kao ..... 206/349

* cited by examiner

*Primary Examiner*—Jim Foster
(74) *Attorney, Agent, or Firm*—Charles E. Baxley

(57) ABSTRACT

A tool display member includes a board and two side pieces are connected to a first side of the board. A gap is defined between the two side pieces and each side piece has an opening defined in an inside thereof. A protrusion extends from an inside of each of the opening and includes a stepped edge so that a tool can be supported and clamped between the stepped edges. A locking plate is fixed to the board and connected between the two side pieces.

1 Claim, 6 Drawing Sheets

TOOL DISPLAY MEMBER

FIELD OF THE INVENTION

The present invention relates to a tool display member having two side pieces on the board of the display member and each side piece has stepped protrusion so as to accommodate the tool of different thickness.

BACKGROUND OF THE INVENTION

A conventional tool display member generally includes a board with a hole or slot so that the board is able to be hung on a wall and a tool is fixed to the board so that the tool can be displayed clearly without too much being covered or hidden. Although the conventional tool display member has been used for a long period of time, it is noticed that the tool is not positioned securely on the tool display member because the tools have different shapes and thickness which may not meet the condition of the conventional tool display member and therefore the tool can be shifted and this could damage the display member itself. Besides, most of the conventional tool display members only provide a place for the tool to be attached thereon and the tool can be easily disconnected from the board of the tool display member.

The present invention intends to provide a tool display member that clamps the tool securely according to the thickness of the tool.

SUMMARY OF THE INVENTION

In accordance with one aspect of the present invention, there is provided a tool display member that comprises a board with a slot and two side pieces are connected to a front surface of the board with a gap between the two side pieces. Each side piece has an opening so that a part of a tool is supported between the two side pieces.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
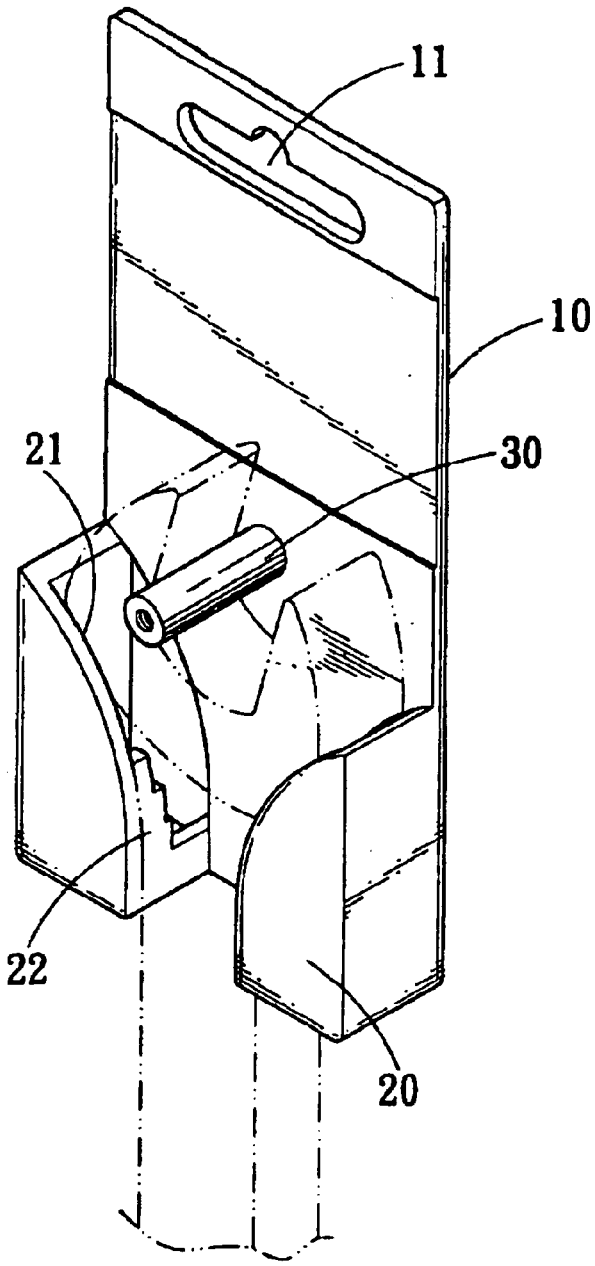
FIG. 1 is a perspective view to show the tool display member of the present invention and a head of a tool is supported by the two side pieces on the board.
Figure 2:
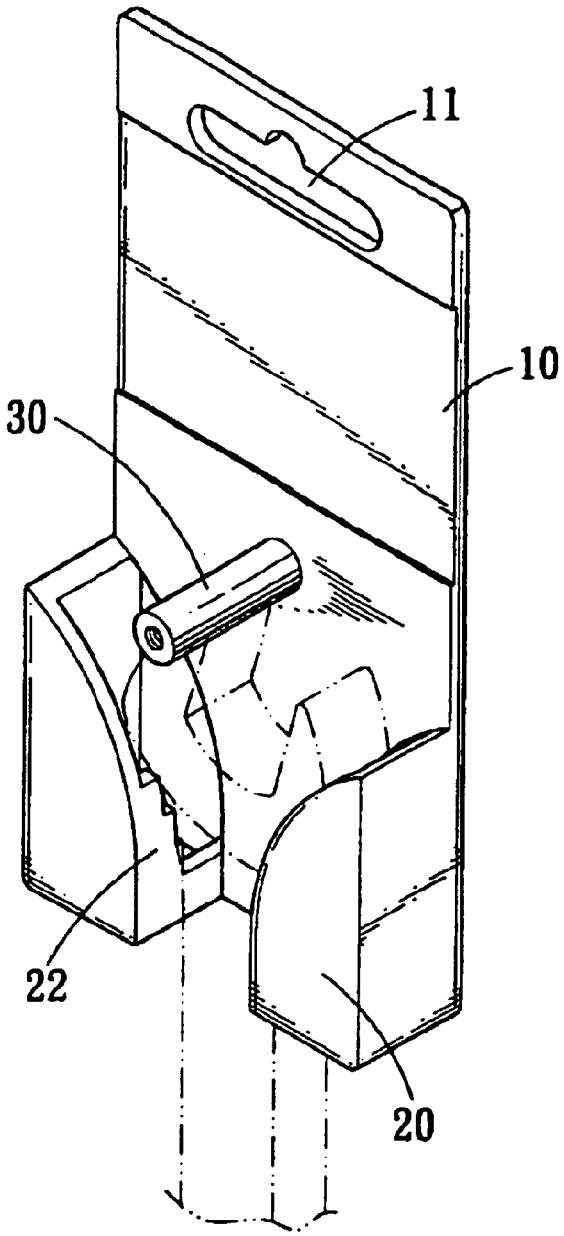
FIG. 2 is a perspective view to show the tool member of the present invention and a smaller head of a tool is supported by the two side pieces on the board.
Figure 3:
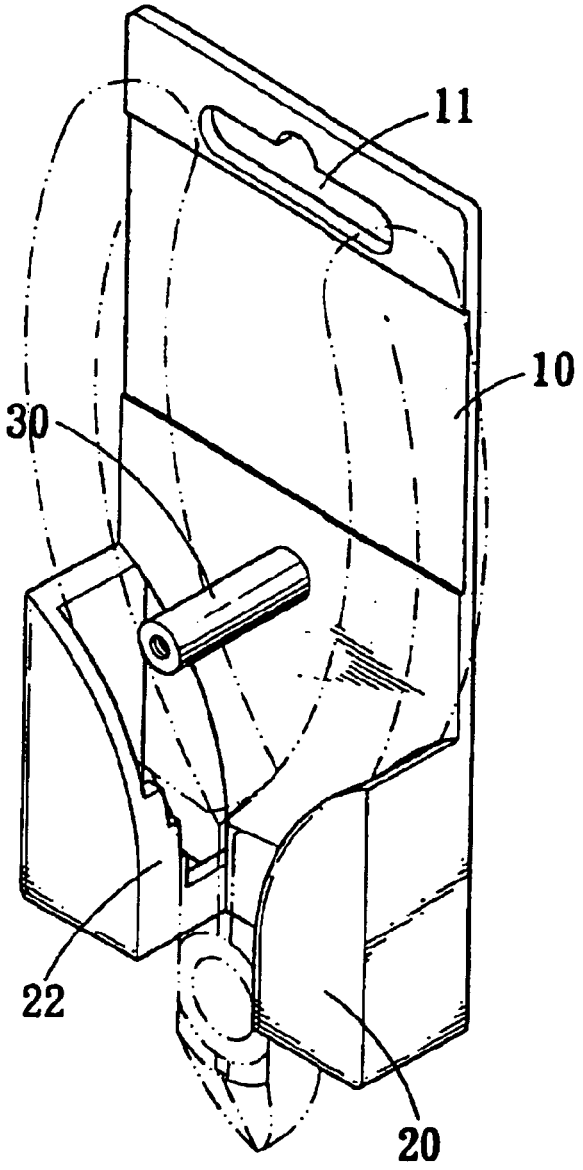
FIG. 3 is a perspective view to show the tool display member of the present invention and a pliers is supported by the two side pieces on the board.

Referring to FIGS. 1 to 3, the tool display member of the present invention comprises a board 10 through which a slot 11 is defined so that the board 10 can be hung on a wall. Two side pieces 20 are connected to a first side of the board 10 and a gap is defined between the two side pieces 20. Each sidepiece 20 has an opening 21 defined in an inside thereof and a protrusion 22 extends from an inside of the opening 21. Each of the protrusions 22 has a stepped edge and different width of gaps is defined between the stepped edge and the first side of the board 10. The stepped edge is formed vertical to the board 10. Therefore, tools such as wrench or pliers can be supported between the two sidepieces 20 and a head of the tool can be clamped between one of the stepped surfaces of the stepped edge and the first side of the board 10. In other words, the tools having different thickness can be securely clamped by the stepped edge.

Figure 4:
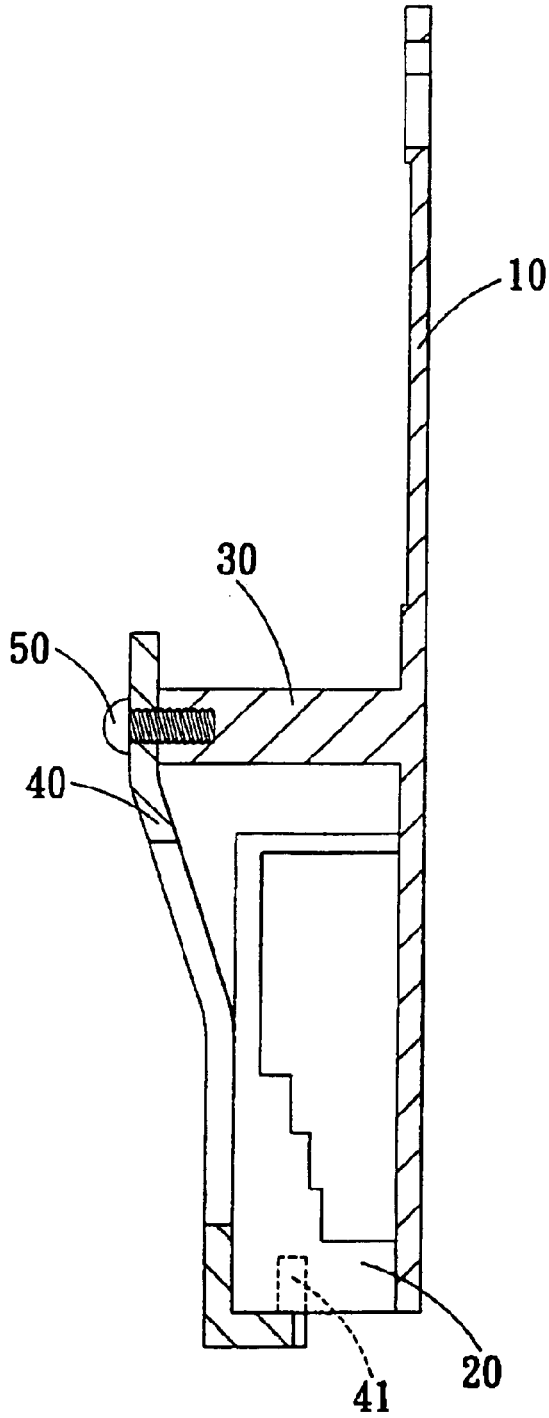
FIG. 4 is an exploded view to show the tool display member and a locking plate.
Figure 5:
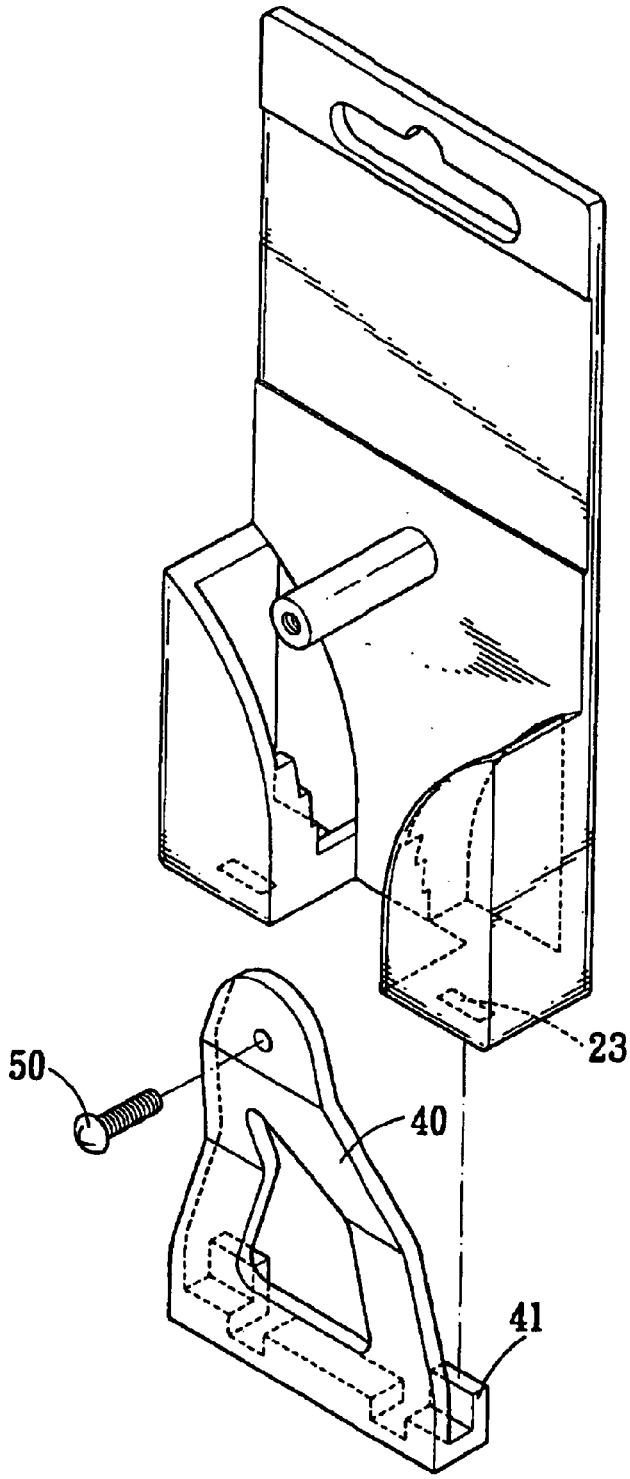
FIG. 5 is a side cross sectional view to show the locking plate connected to the board.
Figure 6:
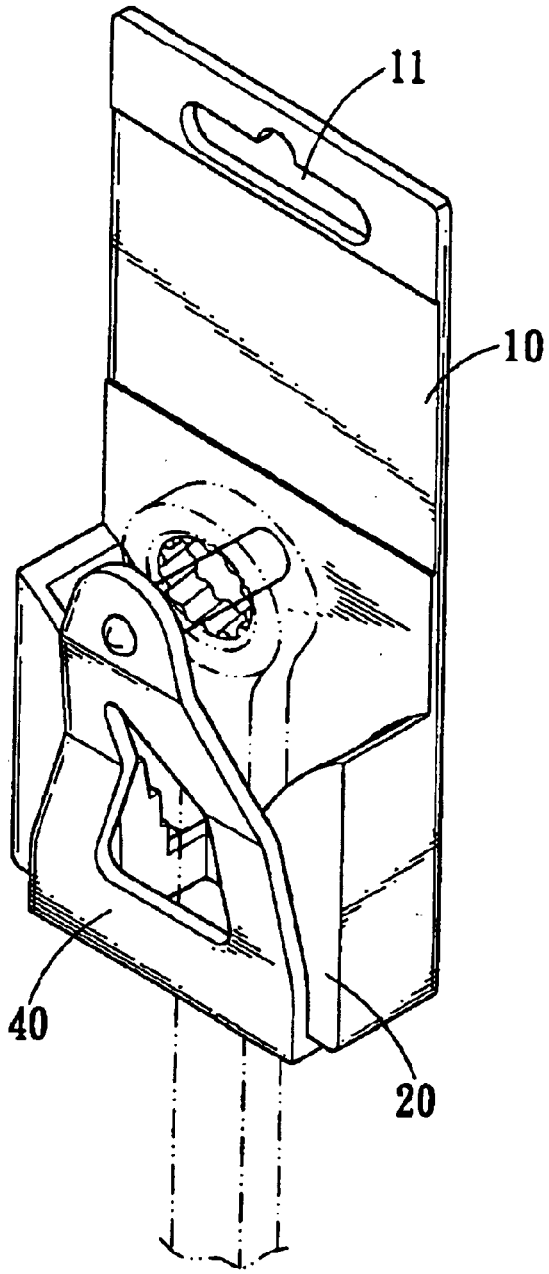
FIG. 6 shows a box-end wrench is locked on the board by the locking plate.

Referring to FIGS. 4 to 6, a rod 30 extends from the first side of the board 10 and has a threaded hole. A locking plate 40 is fixed to the rod 30 by a screw 50 extending through the locking plate 40 and engaged with the rod 30, and connected between the two side pieces 20. The locking plate 40 has two tongues 41 extending from a lower edge thereof and each side pieces 20 has a hole 23 defined in an underside thereof, so that the two tongues 41 are engaged with the two holes 23 in the two side pieces 20.

The tool will not shifted because the head of the tool is well clamped between the two side pieces 20. The locking plate 40 prevents the tool from being taken from the display member.

While we have shown and described the embodiment in accordance with the present invention, it should be clear to those skilled in the art that further embodiments may be made without departing from the scope of the present invention.

What is claimed is:

1. A tool display member comprising:

a board and two side pieces connected to a first side of the board, a gap defined between the two side pieces, each side piece having an opening defined in an inside thereof;

a rod extending from the first side of the board and a locking plate is fixed to the rod by a screw extending through the locking plate and engaged with the rod;

wherein each side pieces has a protrusion extending from an inside of the opening and the protrusion has a stepped edge, and the stepped edge is formed vertically to the board.

* * * * *